US006439498B1

(12) United States Patent
Hufschmidt et al.

(10) Patent No.: US 6,439,498 B1
(45) Date of Patent: Aug. 27, 2002

(54) APPARATUS AND METHOD FOR WINDING A WEB OF TAPES OR YARNS

(75) Inventors: Klaus Hufschmidt, Remscheid; Peter Duda, Radevormwald-Herbeck, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/698,925

(22) Filed: Oct. 27, 2000

(30) Foreign Application Priority Data

Oct. 27, 1999 (DE) ..... 199 51 692

(51) Int. Cl.[7] ..... B65H 18/08; B65H 67/04; B65H 19/30

(52) U.S. Cl. ..... 242/471; 242/473.6; 242/530; 242/533; 242/157 R

(58) Field of Search ..... 242/471, 473.5, 242/473.6, 530–530.4, 533, 157 R

(56) References Cited

U.S. PATENT DOCUMENTS 1,013,490 A * 1/1912 Hellberg ..... 242/530.4
4,157,793 A * 6/1979 Lucia ..... 242/157 R
4,566,645 A * 1/1986 Hermes ..... 242/415.1
4,591,106 A * 5/1986 Gay ..... 242/473.6
5,274,984 A * 1/1994 Fukuda ..... 242/559.3
5,516,058 A * 5/1996 Omokawa et al. ..... 242/530
5,797,557 A * 8/1998 Wang et al. ..... 242/473.6
5,842,663 A * 12/1998 O'Connor et al. ..... 242/530.1

FOREIGN PATENT DOCUMENTS

DE 3414636 11/1984

* cited by examiner

*Primary Examiner*—Michael R. Mansen
(74) *Attorney, Agent, or Firm*—Alston & Bird LLP

(57) ABSTRACT

An apparatus and a method for winding a web of tapes or yarns to a plurality of packages, wherein a plurality of winding positions are arranged side by side on a long side of the apparatus, with at least one package being wound in each winding position. To distribute the tapes or yarns of the web, a yarn guide bar and a plurality of yarn guides are provided, the yarn guides being associated with respective ones of the winding positions. In this process, the web of tapes or yarns is guided above the winding positions in a distribution plane that extends transverse to the long side of the apparatus. The yarn guide bar is movable so as to permit unimpeded access to the winding positions in a doffing plane which is parallel to the long side of the apparatus, to facilitate doffing of the full packages with the aid of an auxiliary device which can be guided in the doffing plane.

16 Claims, 6 Drawing Sheets

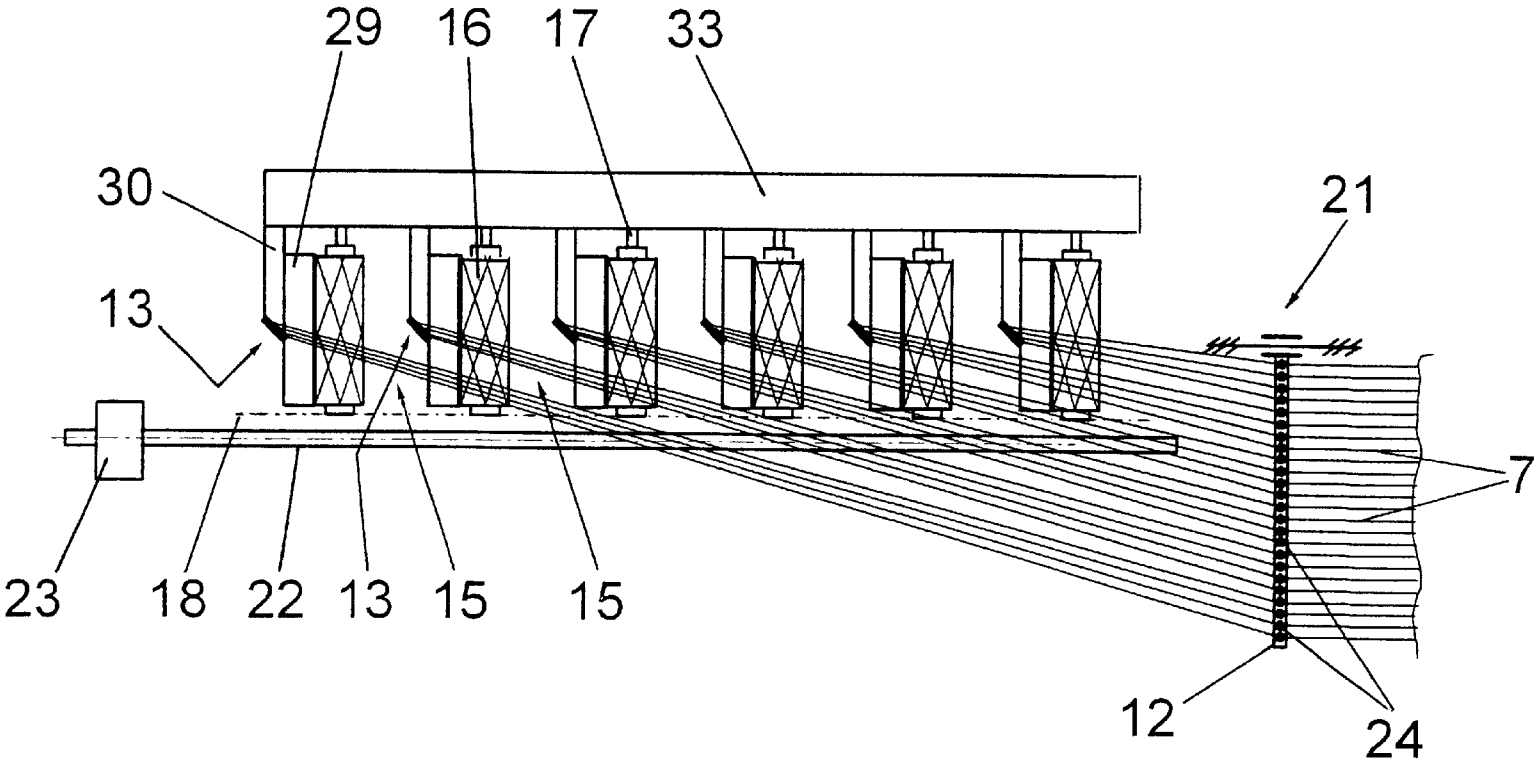
Fig.2.1

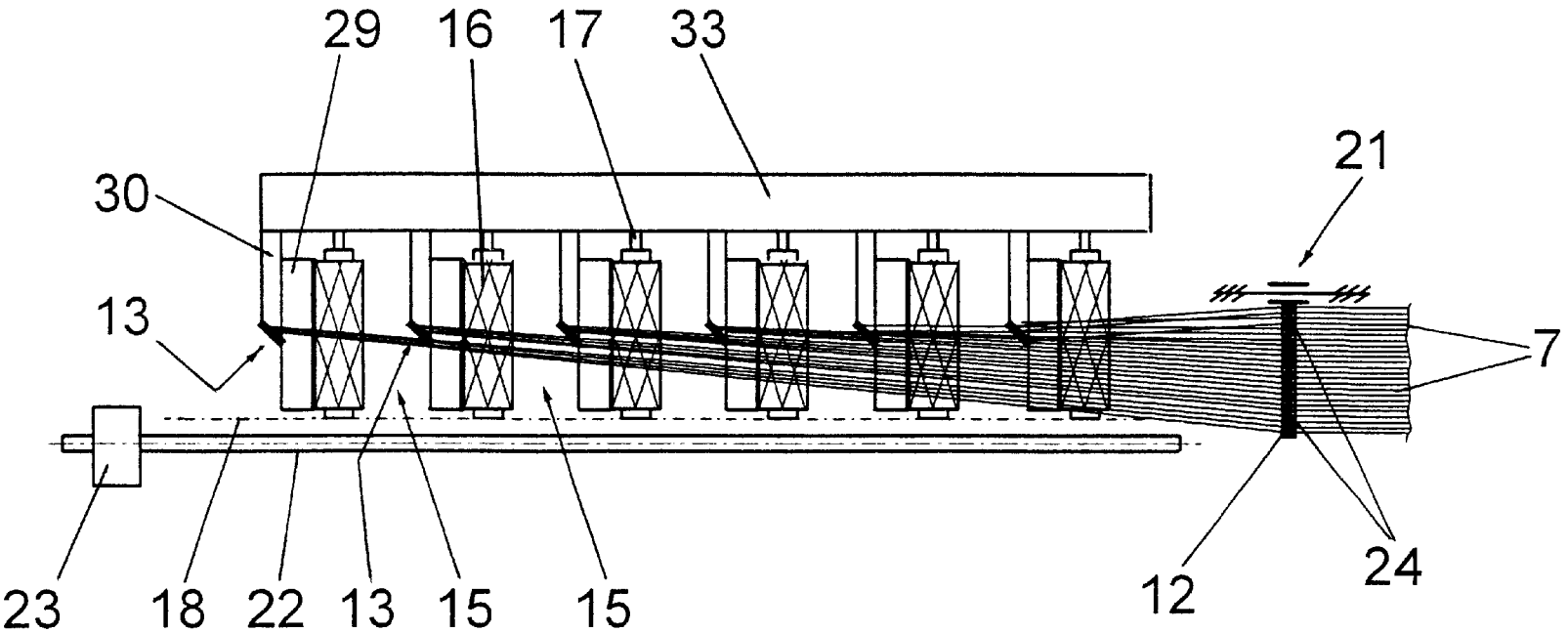
Fig.2.2

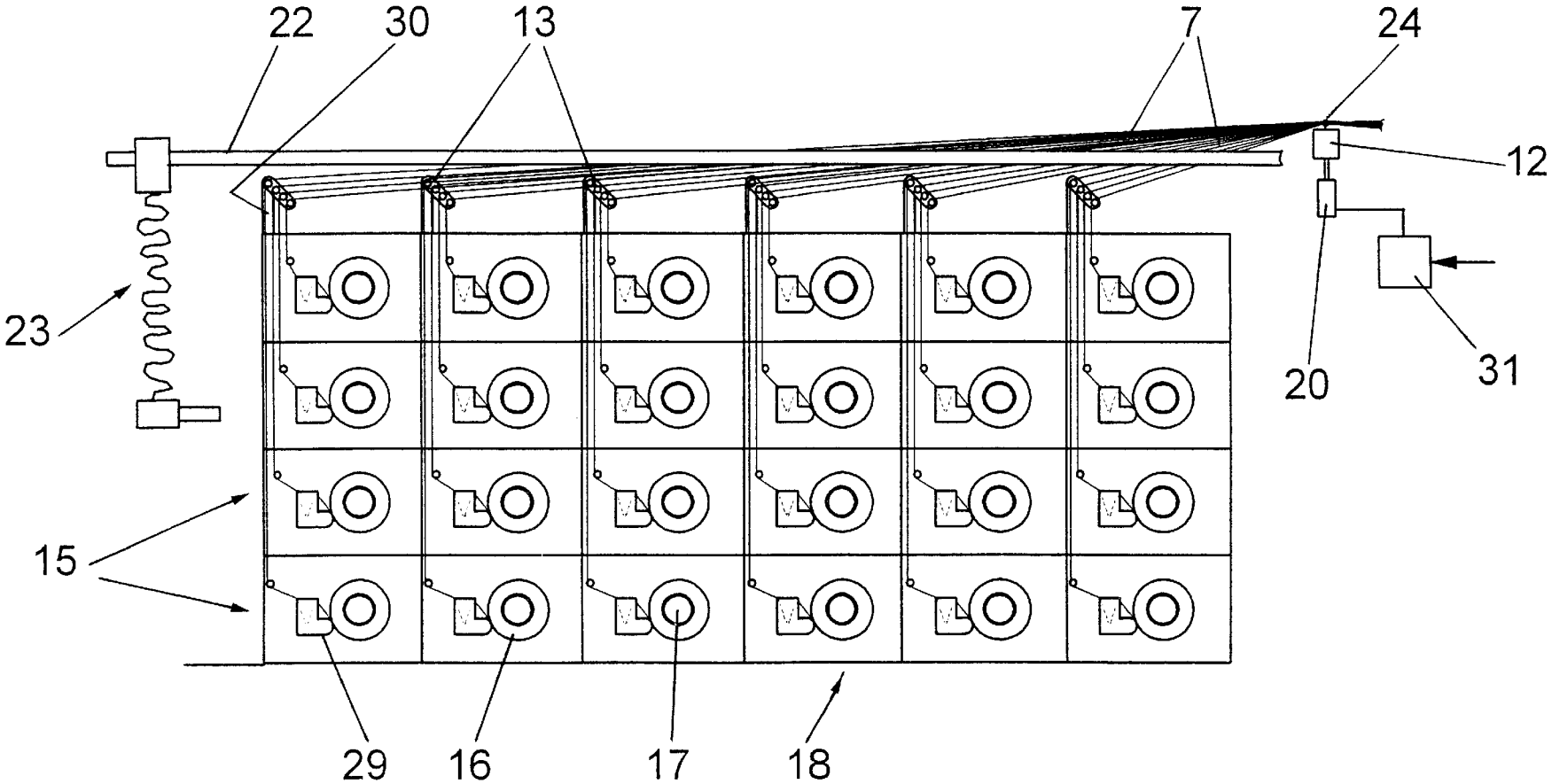
Fig.3.1

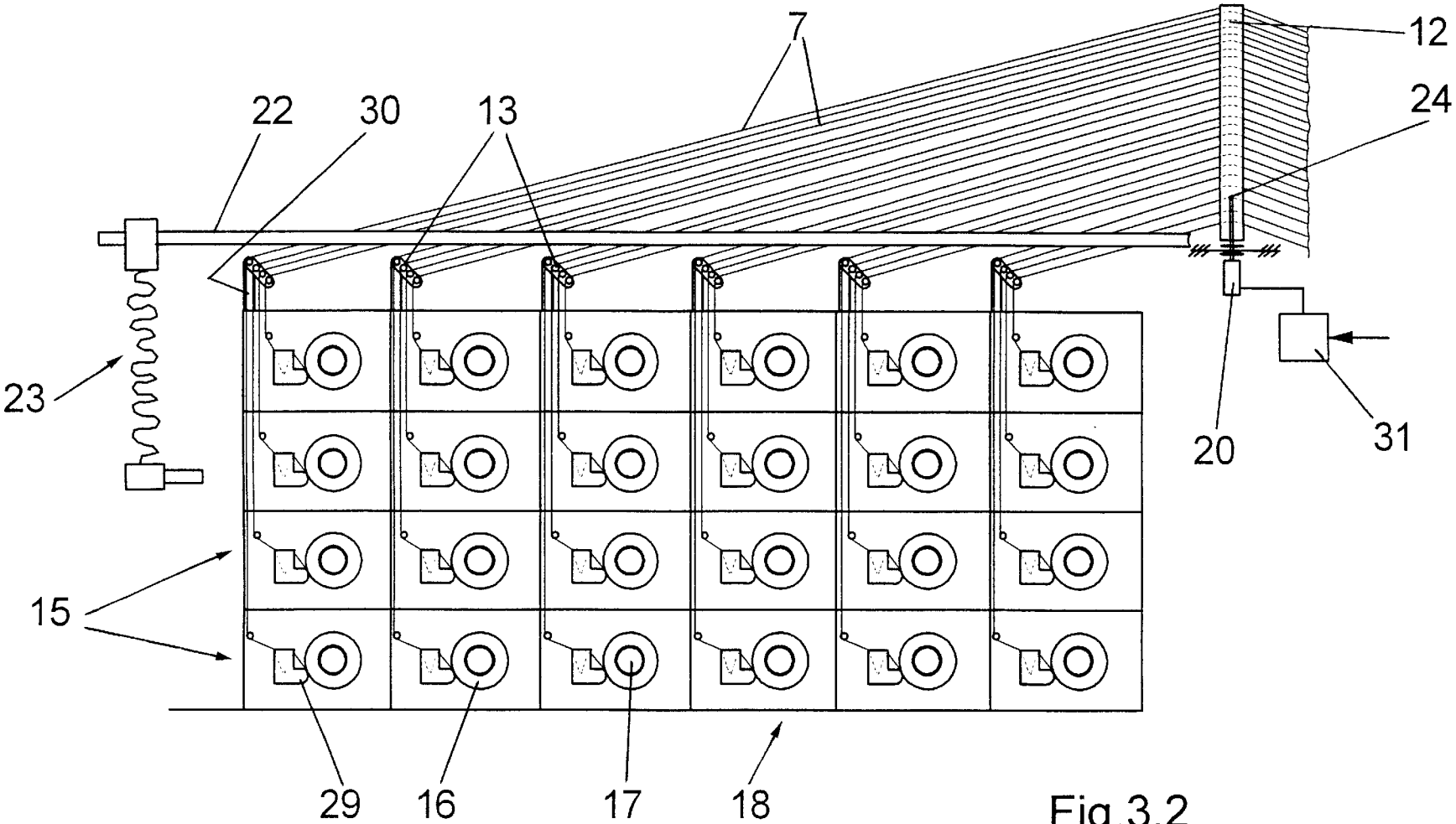
Fig.3.2

APPARATUS AND METHOD FOR WINDING A WEB OF TAPES OR YARNS

BACKGROUND OF THE INVENTION

The invention relates to an apparatus and method for winding a web of tapes or yarns into a plurality of packages.

It is known to produce film tapes from thermoplastic high-polymer plastics for various uses with the therefor required specific product properties. Such uses include, for example, tapes for weaving carpet backings, or for packaging fabric, film tapes for producing twines, cords, or ropes, as well as film tapes as a raw material for splicing yarns and similar products.

In the known extrusion lines, plastics are plasticized in a continuous process, and extruded in the molten state as an endless film by a die, preferably a wide-slot die. This endless film is quenched in a tempered cooling bath to below the softening point of the plastic. After cutting the edges of the endless film, the flat film is divided into a web of narrow, flat tapes, which are monoaxially drawn in a lengthwise orientation between arrangements of rolls or godets, which are designed and constructed preferably as draw units looped by the tapes, and between which hot-air ovens are arranged.

The narrow, flat tapes are wound into respective packages by means of a winding device. As is disclosed, for example, in DE 34 14 636, after leaving the last godet, the web of narrow tapes advances over a yarn guide bar which mounts a plurality of yarn guides, before the individual tapes of the web are distributed to individual winding positions. The winding positions extend along a long side of the machine. To distribute the film tapes, the web of tapes advances in a plane above the winding positions. In each winding position, a tape is wound to a cross-wound package. At the time the package mounted on a winding spindle has reached its intended size, it becomes necessary to doff the package. To this end, the tape is cut and advanced to waste by means of a suction gun. The package is removed from the winding spindle and replaced with an empty tube. Subsequently, the tape is threaded on the empty tube to wind a new package. The package doff is carried out manually. Thus, the known apparatus is suitable only to produce packages with a relatively low weight.

It is therefore an object of the invention to further develop an apparatus and a method of the initially described kind such that it is possible to wind and doff packages of a greater weight, in particular greater than 12 kg.

SUMMARY OF THE INVENTION

The invention distinguishes itself in that it permits doffing the packages in the winding positions with the use of an auxiliary device, which is adapted for unimpeded movement in a doffing plane, which extends parallel to the long side of the machine. In accordance with the invention, the web of slit-film tapes advancing crosswise to the long side of the machine is guided out of a distribution plane for purposes of doffing the packages, so that none of the slit-film tapes traverse the doffing plane. To this end, the yarn guide bar upstream of the winding positions is made movable. Thus, the yarn guide bar is moved out of its operating position only for doffing the packages, in order to deflect the web of slit-film tapes.

According to an advantageous further aspect of the invention, the movement of the yarn guide bar is performed by a drive at a uniform guiding speed. This ensures that no sudden fluctuations in the yarn tension can occur, so that during the movement of the yarn guide bar, winding of the slit-film tape can continue unimpeded.

To be able to perform the movement of the yarn guide bar with simple means, an advantageous further feature of the invention provides that one end of the yarn guide bar is designed and constructed as a pivot bearing. In this instance, a pivot drive pivots the yarn guide bar crosswise to the direction of the advancing yarn. Preferably, a stop is used to define the operating position of the yarn guide bar and its deflected position.

To ensure a great flexibility in winding the slit-film tapes of the web, a preferred further feature of the invention provides that in each winding position the auxiliary device traveling in the doffing plane doffs the packages, one after the other. Preferably, the auxiliary device is formed by a package manipulator arranged on an overhead conveyor. Thus, the package manipulator is used to remove only the full package from the winding spindle of the winding position and to transport the full package, for example, to an adjacent creel.

Since the looping of the individual slit-film tapes of the web changes in the deflected position of the yarn guide bar, a further advantageous feature provides that the yarn guide bar is equipped with a plurality of yarn guides, which each comprise a guide edge partially surrounding the tape for guiding it. This ensure a reliable guidance of the slit-film tapes of the web in each position of the yarn guide bar.

To wind as many tapes or yarns as possible to packages with one device, the winding positions are arranged in a plurality of horizontal rows, one below the other along the long side of the machine. The yarn guides associated to the winding positions for distributing the tapes or yarns extend above the uppermost horizontal row, so that a deflection of the yarn guide bar with the web of tapes or yarns does not affect the distribution to the individual winding positions.

In the cases, wherein the winding positions extend along two long sides of the machine that adjoin in mirror symmetry, a movable yarn guide bar is associated according to the invention to each long side of the machine. This permits doffing packages in winding positions on one long side of the machine independently of the takeup positions of the adjacent long side of the machine.

Preferably, the yarn guide bars are moved independently of each other by means of separate drives at a uniform guiding speed.

In a particularly advantageous further feature of the invention, each winding position is provided with a compensating arm control for purposes of winding the tapes or yarns to a package under a substantially constant tension. Thus, in the winding positions, a change in the tension caused by the different looping in the deflected position of the yarn guide bar, is completely controlled, so that the package can be wound under the same tension.

To ensure an undisturbed advance of the web of slit-film tapes in the components of the extrusion line upstream of the takeup device, a further advantageous feature of the invention comprises a depressor arranged upstream of the yarn guide bar. The depressor guides the web of slit-film tapes in a plane, which enables an undisturbed advance from upstream machine components.

BRIEF DESCRIPTION OF THE DRAWINGS

In the following, further advantages of the invention are described in greater detail with reference to several embodiments and with reference to the attached drawings, in which:

FIGS. 2.1 and 2.2 are schematic top views of a first embodiment of the apparatus according to the invention;

FIGS. 3.1 and 3.2 are schematic side views of the embodiment of the apparatus according to the invention as shown in FIGS. 2.1, 2.2.

DETAILED DESCRIPTION OF THE PREFERRED EMBODIMENTS

Figure 1:
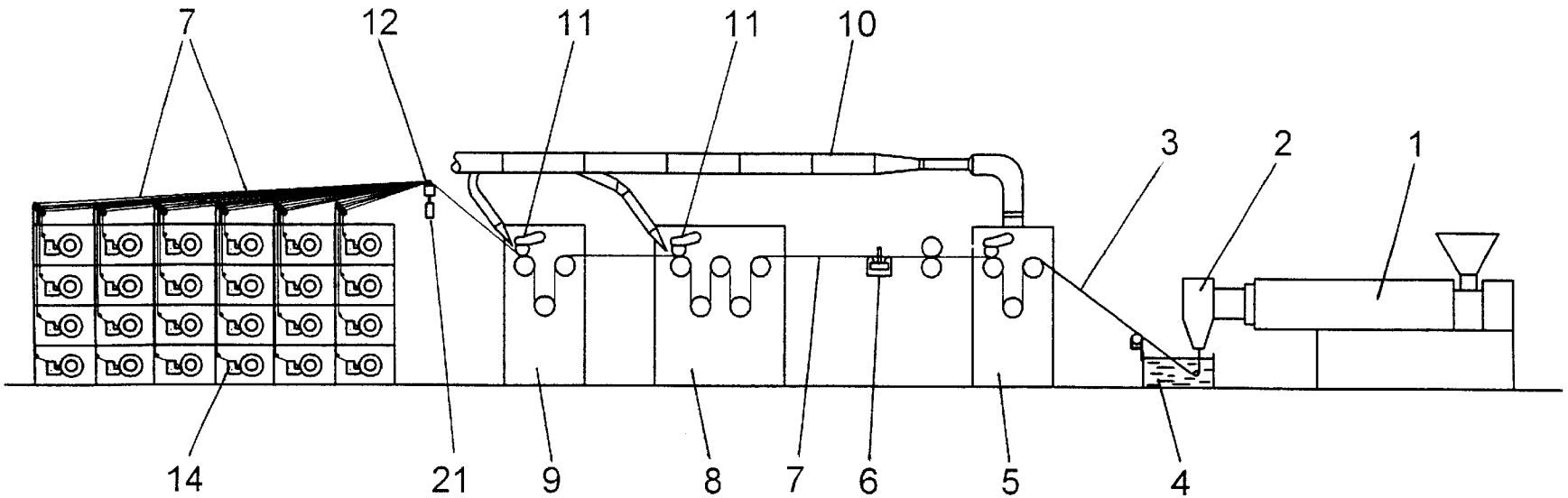
FIG. 1 is a schematic view of an extrusion line for producing slit-film tapes with the apparatus of the present invention.

In a film tape extrusion line as shown in FIG. 1, an extruder 1 is provided for melting a granular plastic. One outlet end comprises a special extrusion die 2, which extrudes a film 3 that may advance into a quench bath 4 downstream thereof, where the film 3 solidifies on its surface. A feed system 5 advances the endless film 3 to a slitter 6. In the slitter 6, individual cutting blades penetrate the film 3, so as to slit it into a web 7 of individual tapes. The web of slit-film tapes 7 advances parallel through a draw zone 8, and subsequently arrives at a delivery system 9, whence it is guided in a horizontally arranged yarn guide bar 12. The draw zone 8 and the delivery system 9 comprise a plurality of godets. Over the circumference the godets, the web of slit-film tapes 7 loops at the greatest possible angle. In contact with the respectively last godet is a pivotally supported contact pressure roll 11. Under the normal pressure thereof, the web of slit-film tapes 7 is pressed against the godet, and in combination with the looping, the holding and draw forces are defined. The draw zone 8 and delivery system 9 connect to a suction device 10, which takes in the tapes during the startup of the extrusion line, i.e., during the threadup of the individual tapes. The suction device also takes in tapes that tear during the operation, so that no laps are able to form on a godet. At the end of the extrusion line, an apparatus 14 of the present invention is arranged for winding the web of slit-film tapes. At its inlet end, the takeup device 14 comprises a yarn guide bar 12, which guides the tapes of web 7 side by side in spaced relationship for distributing them to a plurality of winding positions of the takeup device 14.

In the following, the apparatus of the present invention for winding the web slit-film tapes is described in greater detail with reference to FIGS. 2.1, 2.2 and 3.1, 3.2. FIGS. 2.1 and 2.2 are top views of the takeup device 14, and FIGS. 3.1 and 3.2 are side views thereof. Unless explicitly referred to, the following description applies in like manner to FIGS. 2.1, 2.2 and 3.1, 3.2.

One long side 18 of the apparatus mounts on a machine frame 33 a plurality of winding positions 15 side by side in the horizontal direction, and one below the other in the vertical direction. One horizontal row shows six winding position 15 in side-by-side relationship. In one vertical row, four winding positions 15 overlie one another. The number of the winding positions is exemplary both in the horizontal row and in the vertical row. For example, it is also possible that only three or two winding positions are arranged on top of one another. Likewise, it is possible to extend the horizontal row by additional winding positions.

In each winding position 15, a tape is wound to a package 16. The package 16 is produced on a driven winding spindle 17, which mounts a winding tube for receiving the package 16. The rotational speed of the winding spindle 17 is controlled by means of a compensating arm control 29. In so doing, the tape is wound under a substantially constant tension at a uniform circumferential speed of the package. Above the winding positions, a plurality of yarn guides 13 extends in a distribution plane, with one of the yarn guides 13 being associated to each winding position 15. The yarn guides 13 of one vertical row are held by a vertical support 30. The yarn guide bar 12 is arranged upstream of the yarn guides 13. For each slit-film tape of the web 7, the yarn guide bar 12 comprises one yarn guide 24, which guides the tapes of the web 7 in a horizontal plane. The yarn guide bar 12 extends substantially crosswise to the direction of advance of the web of slit-film tapes 7. At its end facing the drive side of the winding positions 15, the yarn guide bar 12 is mounted for pivotal movement in a pivot bearing 21. The pivot bearing 21 facilitates a pivotal movement of the yarn guide bar 12 crosswise to the direction of the advancing web of film tapes 7 in the direction above the winding positions 15. To perform the pivotal movement a drive 20 engages the underside of the yarn guide bar 12. The drive 20 is designed and constructed as a cylinder-piston unit, which is activatable via a controller 31.

Parallel to the long side 18 of the machine, an overhead conveyor 22 extends above the winding positions 15. The overhead conveyor 22 mounts a package manipulator 23, which can be moved by manual operation on the overhead conveyor 22 along the long side 18 of the machine for removing full packages from the winding positions 15. The guide plane of the package manipulator 23 is referred to as a doffing plane, which extends parallel to the long side 18 of the machine. In the doffing plane, the package manipulator 23 can be moved horizontally and vertically for removing full packages from the winding positions 15.

The slit-film tapes of web 7 are distributed to the winding positions 15 by the yarn guide bar 12 and yarn guides 13 upstream of the winding positions 15 in such a manner that the rear tapes of web 7 are guided to the winding positions 15 of the first vertical row. The additional tapes of web 7 are guided, one after the other, to the additional winding positions 15, so that the front tapes of web 7 reach the winding positions 15 of the last vertical row. In this connection, the web of film tapes 7 extends in a distribution plane beyond the long machine side 18 of the apparatus, so that the web of film tapes 7 extends through the doffing plane. This situation corresponds to the normal operating position, in which the slit-film tapes of web 7 are each wound to a package 16. This situation is shown in FIGS. 2.1 and 3.1.

When the packages 16 on the individual winding spindles 17 reach their proposed size, a package doff will become necessary. At this point, the packages have, for example, a weight of more than 20 kg. Therefore, a package doff will require an auxiliary means for removing and transporting the full packages. Since such takeup devices are normally designed for manual operation, it is preferred to use as an auxiliary means a package manipulator 23, as shown in FIGS. 2.1; 2.2; 3.1; and 3.2. An overhead conveyor 22 moves the package manipulator 23 in a doffing plane parallel to the long side 18 of the machine. To release the doffing plane, which is traversed by the web of slit-film tapes 7 in the operating position, the controller 31 activates the drive 20 for purposes of deflecting the yarn guide bar 12. In this connection, the drive 20 is designed and constructed such that the web of film tapes 7 is deflected slowly and free of pulls, so that the winding of the tapes can continue unimpeded in the winding positions 15. The tension differences that develop from the changed looping of the film tapes of web 7 are controlled by the compensating arm controls 29 in the winding positions 15. After the yarn guide bar has reached a deflected position that is defined by drive 20, the packages will be doffed in the winding positions 15. In the deflected position of the yarn guide bar 12, the doffing plane is free for guiding the package manipulator 23, and is no longer traversed by the web of slit-film tapes 7. For doffing a full package in a winding position 15, the tape is first cut, taken in by the suction device, and removed to waste. Thereafter, the full package is removed from the spindle by means of the package manipulator 23 and taken away. Subsequently, the empty winding spindle receives a new tube, so that winding can continue after threading the tape. FIGS. 2.2 and 3.2 illustrate the situation of a deflected yarn guide bar 12.

Once the packages are doffed, the controller 31 will activate the drive 20 such that the yarn guide bar 12 pivots back to its operating position and, thus, guides the web of slit-film tapes 7 in a horizontal plane.

To obtain during each of the different positions of yarn guide bar 12, a safe guidance of the tapes by the yarn guides 24 mounted thereon, the yarn guides 24 are designed and constructed preferably with a guide edge partially surrounding the tape. Such yarn guides are known, for example, as pigtails, and therefore a description of such yarn guides is omitted.

Figure 4:
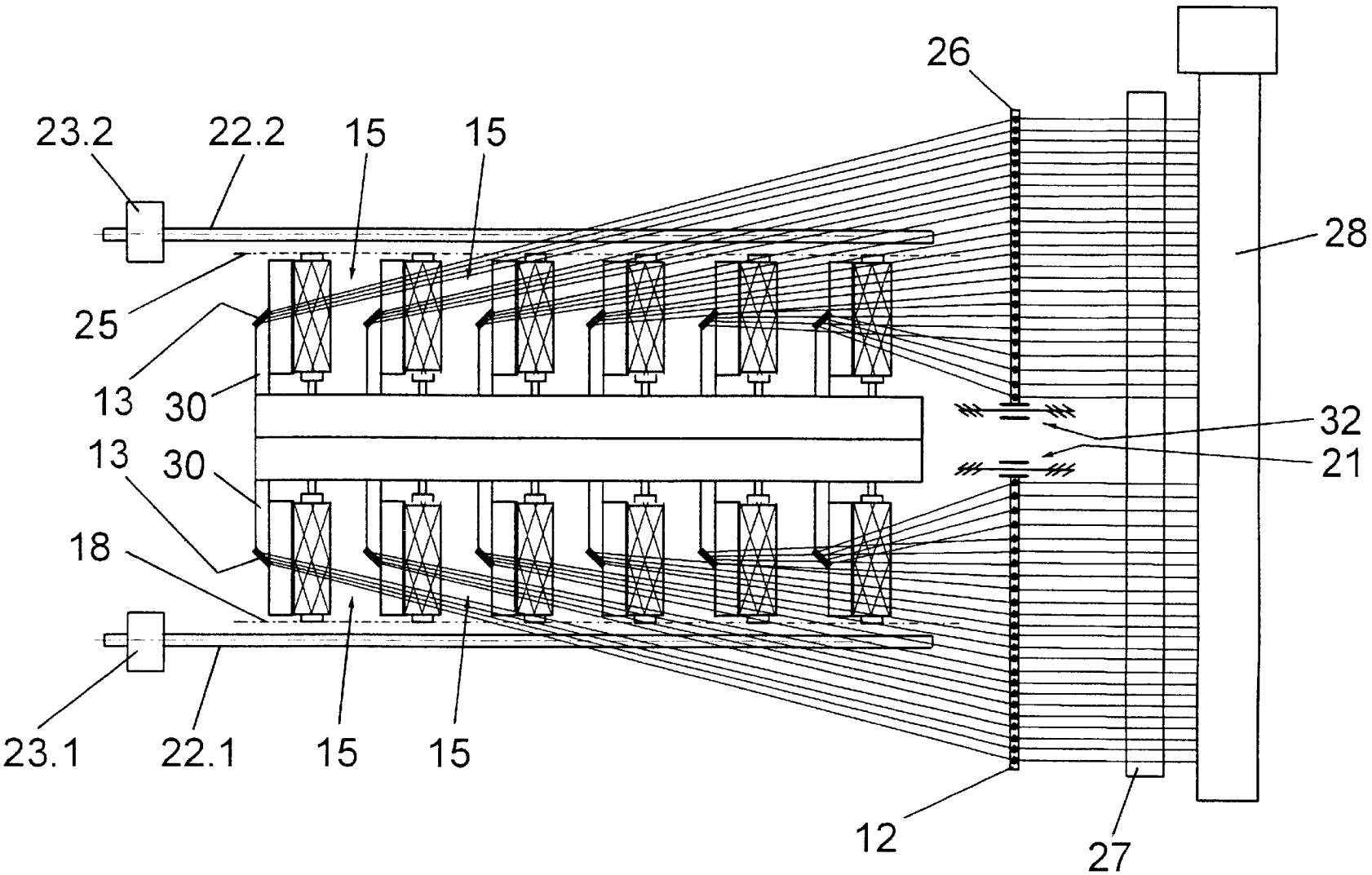
FIG. 4 is a schematic view of a further embodiment of the apparatus according to the invention.

FIG. 4 illustrates a further embodiment of an apparatus of the present invention for winding a web of slit-film tapes 7. In this instance, the apparatus comprises a plurality of winding positions arranged in vertical and horizontal rows along two long sides 18 and 25 of the machine, which adjoin in mirror symmetry. Each long side 18 and 25 of the machine is associated to a package manipulator 23.1 and 23.2, which travel in a doffing plane along overhead conveyors 22.1 and 22.2. To distribute the film tapes of web 7, each long side 18 and 25 of the machine is provided with one yarn guide bar 12 and 26. From the yarn guide bar 12 or 26, the tapes are distributed to the winding positions in a manner corresponding to the above described apparatus of FIGS. 2.1–3.2. To this extent, the foregoing description is herewith incorporated by reference. At its one end, the yarn guide bar 12 is mounted for pivotal movement in pivot bearing 21, and the yarn guide bar 26 is mounted likewise for pivotal movement in a pivot bearing 32. Each yarn guide bar 12 and 26 is associated with its own drive (not shown). The drives may be controlled independently of each another.

Between the yarn guide bars and a last godet 28 of a draw zone, a depressor 27 is provided. The depressor 27 remains unchanged in its position during the winding of the packages and during the doffing of the packages. Thus, the changed looping of the web of film tapes 7 on godet 28, which is caused by the deflection of the yarn guide bar, remains without effect. In addition, the depressor 27 prevents the two parallel guided webs of the slit-film tapes from interfering with each other.

Since the deflection of the yarn guide bar for deflecting the web of slit-film tapes 7 out of the distribution plane for doffing the packages is identical with the embodiment of FIGS. 2.1–3.2, the foregoing description is herewith incorporated by reference. In this connection, it is possible to pivot the yarn guide bars simultaneously, so that the packages can be doffed on both long sides of the machine. However, it is also possible to deflect the yarn guide bars independently of each other, so that it is possible to operate respectively only the winding positions of one long side of the machine.

In the embodiments illustrated in FIGS. 2.1–4, a web of slit-film tapes is wound to packages. However, the embodiments are also suitable for winding without modification a web of yarns or other strandlike materials. The concept of the invention is independent of the material being wound. Essential is the movement of the yarn guide bar for releasing a doffing plane. The movement may also be performed by displacing the yarn guide bar in a guide rail. In so doing, it is necessary that the change in the looping always facilitate a satisfactory winding of the tapes.

That which is claimed:

1. An apparatus for winding an advancing web of tapes or yarns into a plurality of packages, comprising a plurality of winding positions arranged side by side in the direction of the advancing web to define a long side of the apparatus, with provision for winding the tapes or yarns into at least one package at each position, a yarn guide bar mounted upstream of the winding positions when viewed in the direction of the advancing web for guiding the advancing web at a location upstream of the winding positions in a distribution plane which is transverse to the long side of the winding apparatus, a plurality of yarn guides positioned to be associated with respective ones of the winding positions and such that the tapes or yarns of the web are guided by the yarn guide bar and the yarn guides to the respective winding positions, and said yarn guide bar being movably mounted so as to permit unimpeded movement along a doffing plane which is transverse to the distribution plane and parallel to the long side of the apparatus.

2. The winding apparatus as defined in claim 1 further comprising an auxiliary device for assisting in the doffing of full packages, said auxiliary device being mounted for movement in the doffing plane along the long side of the apparatus so as to permit its use at each of the winding positions.

3. The winding apparatus as defined in claim 2 wherein the yarn guide bar is mounted for movement between an operative position wherein at least a portion of the tapes or yarns is deflected laterally from the yarn guide bar across the doffing plane to the associated yarn guides, and a deflected position wherein substantially no portion of the web extends across the doffing plane.

4. The winding apparatus as defined in claim 3 wherein the yarn guide bar is pivotally mounted at one end thereof such that in the operative position the yarn guide bar extends transversely across and parallel to the distribution plane, and in the deflected position the yarn guide bar is inclined with respect to the distribution plane.

5. The winding apparatus as defined in claim 4 further comprising a drive for effecting movement of the yarn guide bar at a uniform guiding speed between the operative and deflected positions.

6. The winding apparatus as defined in claim 2 wherein the auxiliary device is mounted for movement along an overhead conveyor which extends along the long side of the apparatus.

7. The winding apparatus as defined in claim 2 wherein the winding positions are arranged in vertically spaced apart horizontal rows, with the yarn guides being mounted above an uppermost one of the rows.

8. The winding apparatus as defined in claim 7 wherein the yarn guide bar mounts a plurality yarn guides, with each of the yarn guides of the yarn guide bar being configured so as to partially surround one of the tapes or yarns of the advancing web.

9. The winding apparatus as defined in claim 2 wherein the winding positions are arranged to define two long sides of the apparatus which are in a mirror image relationship to each other, and wherein a moveable yarn guide bar is associated with each of said two long sides.

10. The winding apparatus as defined in claim 9 wherein each of said moveable yarn guide bars is independently moveable by means of separate drives.

11. The winding apparatus as defined in claim 2 wherein each of said winding positions includes a compensating arm control for winding the associated tape or yarn into a package under a substantially constant tension.

12. The winding apparatus as defined in claim 2 further comprising a depressor mounted upstream of the yarn guide bar for guiding the web of tapes or yarns in one plane before they contact the yarn guide bar and wherein the depressor remains unchanged in its position during movement of the guide bar.

13. The method of winding an advancing web of tapes or yarns into respective packages, comprising the steps of guiding the advancing web of tapes or yarns to a plurality of winding positions which are arranged side by side in the direction of the advancing web to define a long side of the apparatus, with each tape or yarn being wound to a package at a respective winding position, while contacting the advancing web with a yarn guide bar which is mounted in an operative position upstream of the winding positions so as to guide the advancing web in a distribution plane which is transverse to the long side of the apparatus, and selectively moving the yarn guide bar to a deflected position wherein the advancing web is deflected so as to permit unimpeded access to the winding positions to facilitate doffing of full packages at the winding positions.

14. The method of winding an advancing web as defined in claim 13 wherein in the distribution plane, at least a portion of the advancing web of advancing tapes or yarns is deflected laterally from the yarn guide bar across a doffing plane which is adjacent and parallel to the long side of the apparatus, and wherein in the deflected position of the yarn guide bar the advancing web is guided so that substantially no portion thereof extends across the doffing plane.

15. The method of winding an advancing web as defined in claim 14 comprising the further steps of moving an auxiliary device along the long side of the apparatus and within the doffing plane while the yarn guide bar is in the deflected position, and employing the auxiliary device for assisting in the doffing of full packages.

16. The method of winding an advancing web as defined in claim 15 wherein the auxiliary device is moved along an overhead conveyor, and wherein the auxiliary device is configured as a package manipulator.

* * * * *